United States Patent [19]

Tisbo et al.

[11] 4,304,059

[45] Dec. 8, 1981

[54] MOLDED PLASTIC OPEN FACE GARDEN MARKER

[75] Inventors: Cosmo N. Tisbo; Thomas A. Tisbo, both of Barrington, Ill.

[73] Assignee: Custom Plastics, Inc., Elk Grove Village, Ill.

[21] Appl. No.: 216,391

[22] Filed: Dec. 15, 1980

[51] Int. Cl.[3] ..... G09F 3/18; A47G 1/06

[52] U.S. Cl. ..... 40/10 C; 40/158 B

[58] Field of Search ..... 40/10 C, 10 R, 158 R, 40/10 D, 158 B

[56] References Cited

U.S. PATENT DOCUMENTS

| | | | |
|---|---|---|---|
| 477,696 | 6/1892 | Paige | 40/158 B |
| 1,474,174 | 11/1923 | Segall | 40/158 B |
| 1,983,815 | 12/1934 | Schmiett | 40/10 C |
| 3,057,093 | 10/1962 | Gallo | 40/10 C |
| 3,432,954 | 3/1969 | Ford | 40/10 R |
| 4,079,530 | 3/1978 | Atherton | 40/10 C |
| 4,196,533 | 4/1980 | Kamphausen | 40/10 C |

*Primary Examiner*—Gene Mancene
*Assistant Examiner*—Michael J. Foycik
*Attorney, Agent, or Firm*—Anthony S. Zummer

[57] ABSTRACT

The instant invention relates to an improved open face garden marker which is a molded unitary plastic device. The instant marker includes an open continuous ring having a plurality of ears formed integral with the interior of the ring extending inward. The ears are staggered for receiving an indicating indicia between the ears and holding the indicia between the ears. A shank is formed integral with the continuous ring and extends outward from the ring. The shank has a point on one end for engagement with the earth to facilitate insertion of the marker into the earth. Measuring indicia is formed integral with the shank for indicating depth of insertion of the shank into earth.

1 Claim, 6 Drawing Figures

MOLDED PLASTIC OPEN FACE GARDEN MARKER

BACKGROUND OF THE INVENTION

Gardeners often find it is advantageous to place indicating indicia to identify the location of different seeds which have been planted in the earth. It may be readily appreciated that when gardeners plant certain seeds of given plants, they wish to keep the garden clear of weeds which may sprout up. Rather than allowing weeds to get an early start, gardeners prefer to pull the weeds when they are small, thereby creating a minimum of disturbance for the desirable plants. Often times, gardeners will plant rows of seeds of selected plants. They wish to mark what type of seen has been planted in a particular row so that they can readily distinguish desirable seedlings from undesirable growths. Typically, gardeners will place a stick at the end of a row and place a seed packet over the stick. It has been found that the wind will often blow off the packet or rain will effectively weaken the material of the packet so that the packet will fall off.

In certain instances, it is desirable for gardeners to write information on cardboard or other material adjacent to rows of planted seeds. Garden markers are well known. A typical garden marker is taught in U.S. Pat. No. 3,057,093 to Gallo. The concept of providing a unitary plastic marker is taught in U.S. Pat. No. 4,196,533 to Kamphausen. A number of other patents disclose garden markers of various types; that is; U.S. Pat. No. 1,984,395 to Choate, U.S. Pat. No. 2,012,990 to Choate, U.S. Pat. No. 2,207,180 to Smith et al, U.S. Pat. No. 2,639,524 to Irving, and U.S. Pat. No. 2,807,897 to Reynolds.

In planting gardens, it has been found that it is necessary for gardeners to be able to measure the depth of a planting to place the seed at the proper depth. It is, therefore, desirable to provide a garden tool which may be used for making a trench for receiving seeds or individual holes for receiving individual seeds, simultaneously measuring the depth at which the seed is planted. The device is then used as a marker by providing a holder for receiving indicating indicia which holder requires no tools for receiving the indicia.

SUMMARY OF THE INVENTION

The present invention provides a garden marker which may be readily used as a garden tool for planting seeds then upon completion of the planting provides a device for receiving indicating indicia to hold selected information at a position where the device is located. The garden marker includes a molded unitary plastic part which combines lightweight and strength and includes a continuous ring. The continuous ring has a plurality of ears formed integral therewith extending inward for receiving and holding indicating indicia within the ring. A shank is formed integral with the ring and extends away from the ring with a point on the end farthest away from the ring. Measuring indicia is formed integral with the shank for indicating depth of penetration of the shank into earth, thereby, providing a convenient means for determining depth of planting.

DESCRIPTION OF PREFERRED EMBODIMENT

Figure 3:
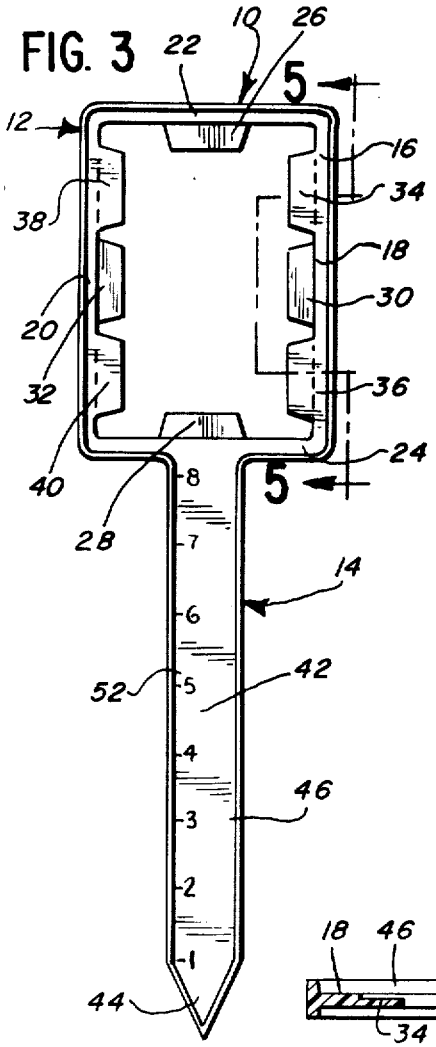
FIG. 3 is a front elevational view of one of the garden markers of FIG. 1 being a specific embodiment of the herein disclosed invention.
Figure 4:
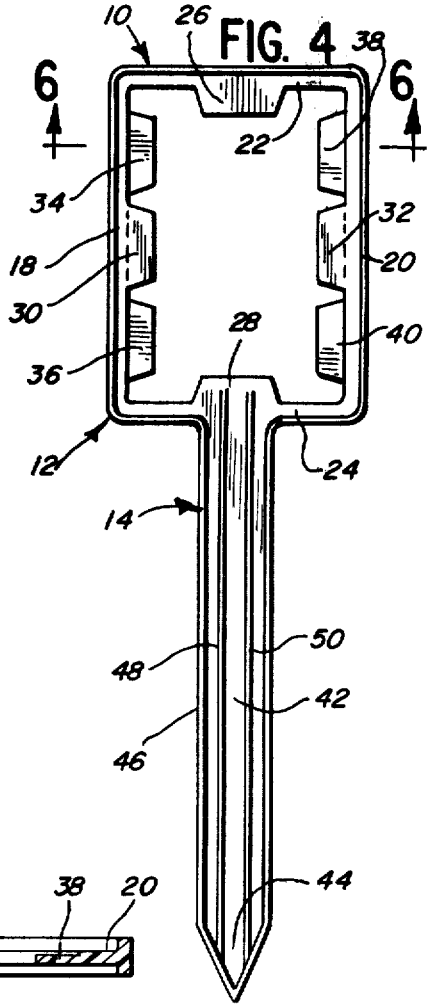
FIG. 4 is a rear elevational view of the garden marker of FIG. 3.
Figure 5:
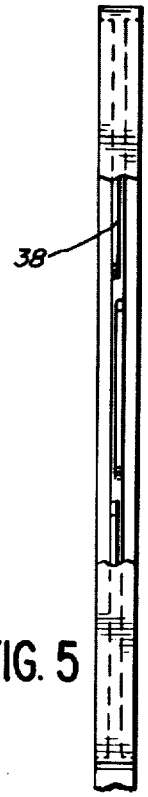
FIG. 5 is an enlarged partial cross-sectional view taken on line 5—5 of FIG. 3 showing the inter-relationship of ears and outer rib of the garden marker.
Figure 6:
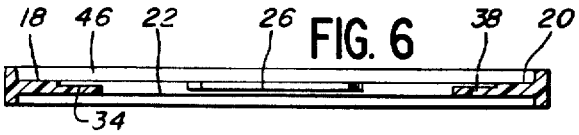
FIG. 6 is a cross-sectional view taken on line 6—6 of FIG. 4 showing the inter-relationship of ears of the garden marker.

Referring now to the drawings, especially to FIGS. 3 and 4, an open face garden marker embodying the herein described invention is shown therein and is generally indicated by numeral 10. The garden marker 10 is a unitary molded plastic part and generally includes an identification holder 12 and a stake 14 formed integral with the identification holder. The identification holder is a single piece of molded plastic. The molded plastic is any one of a suitable plastic, such as, polyvinyl cloride. However, any suitable plastic may be used, such as, polyethylene or nylon.

The identification holder 12 includes a continuous ring 16 which has a pair of parallel long walls 18 and 20. A pair of short walls 22 and 24 is formed integral with the long walls to define a rectangle.

A plurality of ears is formed integral with the continuous ring. The ears extend inwardly as is best shown in FIG. 4. The ears include a pair of end ears 26 and 28 which are formed integral with short walls 22 and 24, respectively. A pair of center ears 30 and 32 is formed integral with long walls 18 and 20, respectively. The center ears are positioned in the center of the respective long walls. A pair of side ears 34 and 36 is formed integral with long wall 16 on opposite sides of center ear 30. A pair of side ears 38 and 40 is formed integral with long wall 20 on opposite sides of center ear 32. End ears 26 and 28 and center ears 30 and 32 are all on one plane. The side ears 34, 36, 38 and 40 are all on a second plane offset from the plane defined by the end ears and the center ears. Thus, the adjacent ears are offset from each other or staggered for receiving an identification indicia between the ears and thereby, hold the identification indicia.

The stake includes a shank 42. Shank 42 is positioned in the middle of short wall 24 aligned with end ear 28. The shank is parallel to long walls 18 and 20. A point 44 is formed integral with the end of the shank 42.

A reinforcing outer rib 46 is formed integral with the outer periphery of the shank, the point and continuous ring 16.

A pair of longitudinal reinforcing ribs 48 and 50 is formed integral with one side of the shank. The ribs extend from ear 28 to point 44 and each has one end formed integral with outer rib 46 as may be seen in FIG. 4.

Measuring indicia 52 is formed integral on the other side of the shank. In this instance, the measuring indicia is set out in one inch increments, that is, the number one is placed one inch above the end of point 44 and number two is placed one inch above number one. The succeeding numbers are each placed one inch above the preceding number until number eight is reached, which is eight inches above the end of point 44 as shown in FIG. 3. It is readily apparent, other linear measuring systems may be used other than inches or one inch increments.

Figure 1:
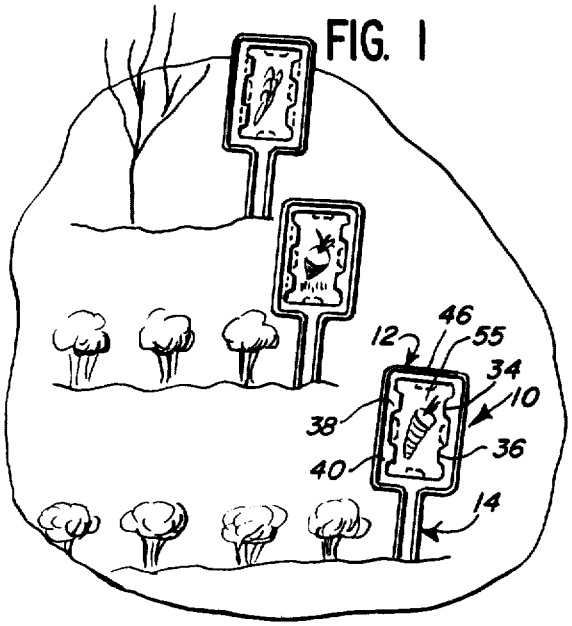
FIG. 1 is a perspective view of a portion of a garden showing a plurality of garden markers embodying the present invention mounted in earth of the garden.
Figure 2:
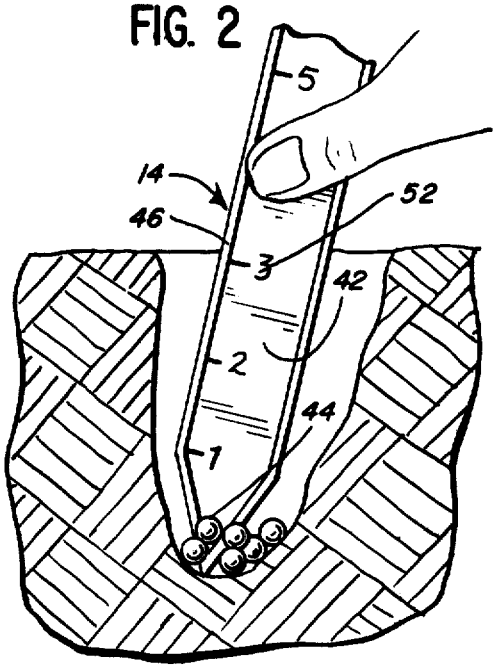
FIG. 2 is an enlarged cross-sectional view of a portion of earth showing a portion of the garden marker of FIG. 1 positioned in a trough in the earth for indicating the depth of the trough.

As was mentioned above, the present garden marker is a single unitary piece of plastic. The rib construction allows the device to be lightweight which reduces molding and shipping costs and facilitates handling of the device. The marker may be used for making a trench or trough in prepared ground by inserting the point to the selected depth and pulling the marker through prepared ground. Alternatively, the marker may be used to provide openings for receiving seeds by inserting the point into the ground and pushing it down to a selected depth and making a hole for receiving a seed. Once a row or area has been planted, if it is necessary to add identification indicia, suitable indicating indicia may be mounted in holder 12. For instance, a seed packet 55 may be placed between the ears. Side ears 34, 36, 38 and 40 engage one side of seed packet 55 as shown in FIG. 1, and ears 26 and 28 and center ears 30 and 32 engage the other side of the packet. Thus, the indicating indicia is securely held in position providing a neat appearance and still providing the necessary identification. Alternatively, a suitable piece of material for receiving writing may be placed between the ears as described above. The garden marker with the indicating indicia then may be easily inserted by placing the point of the marker into the earth to a selected depth.

Although a specific embodiment of the herein described invention has been shown in detail on the accompanying drawing and described above, it is to be expressly understood that those skilled in the art may make various modifications and changes without departing from the spirit and scope of the present invention. It is to be expressly understood that the instant invention is limited only by the appended claims.

What is claimed is:

1. A molded plastic open face garden marker comprising; a continuous ring defining a rectangle, said continuous ring having a pair of long sides and a pair of short sides, each of said short sides having an ear formed integral therewith and extending toward the opposite side, each of said long sides having a center ear formed integral therewith extending toward the opposite center ear, said center ears and the ears on the short side being in the same plane, a pair of side ears formed integral with each of the long sides on opposite sides of the center ears and extending toward the opposite long side, said side ears being in a second plane spaced away from the plane defined by the center ears and the ears on the short sides for receiving indicating indicia between the ears and holding the indicia in position; a shank formed integral with the center of one of said short sides and extending away from the continuous ring, said shank being parallel to the long sides, said shank having a point on the end spaced away from the continuous ring; an outer rib formed integral with the outer periphery of the continuous ring and with the outer periphery of the shank including the point; and a pair of reinforcing longitudinal ribs formed integral with the shank and having their respective ends formed integral with a portion of the outer rib.

* * * * *